US006522068B2

(12) United States Patent
Van Egmond et al.

(10) Patent No.: US 6,522,068 B2
(45) Date of Patent: Feb. 18, 2003

(54) FLUORESCENT LAMP, AND METHOD OF MANUFACTURING SAME

(75) Inventors: Suzanne Van Egmond, Eindhoven (NL); Jan Willem Frederik Dorleijn, Roosendaal (NL); Stephen Charles Fancher, Clarksburg, WV (US); Tommy Lee Harmon, Durham, KS (US); Frank Latassa, Roosendaal (NL); Josephus Theodorus Van Der Eyden, Eindhoven (NL)

(73) Assignee: Koninklijke Philips Electronics N.V. (NL)

( * ) Notice: Subject to any disclaimer, the term of this patent is extended or adjusted under 35 U.S.C. 154(b) by 159 days.

(21) Appl. No.: 09/779,303

(22) Filed: Feb. 8, 2001

(65) Prior Publication Data

US 2002/0135300 A1 Sep. 26, 2002

(51) Int. Cl.[7] ..... H01K 1/50
(52) U.S. Cl. ..... 313/567; 313/637
(58) Field of Search ..... 313/567, 574, 313/637

*Primary Examiner*—Vip Patel
(74) *Attorney, Agent, or Firm*—Dicran Halajian; Frank J. Keegan

(57) ABSTRACT

Fluorescent lamp (1) comprising a glass discharge vessel (2) in which a gas is present, which discharge vessel (2) is on two sides provided with a tubular end portion (3) having a longitudinal axis, which end portion (3) includes a glass stem (5), wherein an exhaust tube (6) extends axially outwardly from said stem (5) for supplying and/or discharging gases during the production of the lamp (1), wherein an electrode (8) extends axially inwardly through the stem (5) for generating and maintaining a discharge in the discharge vessel (2). The fluorescent lamp (1) is characterised in that it meets at least one of the following equations:

Figure 1:
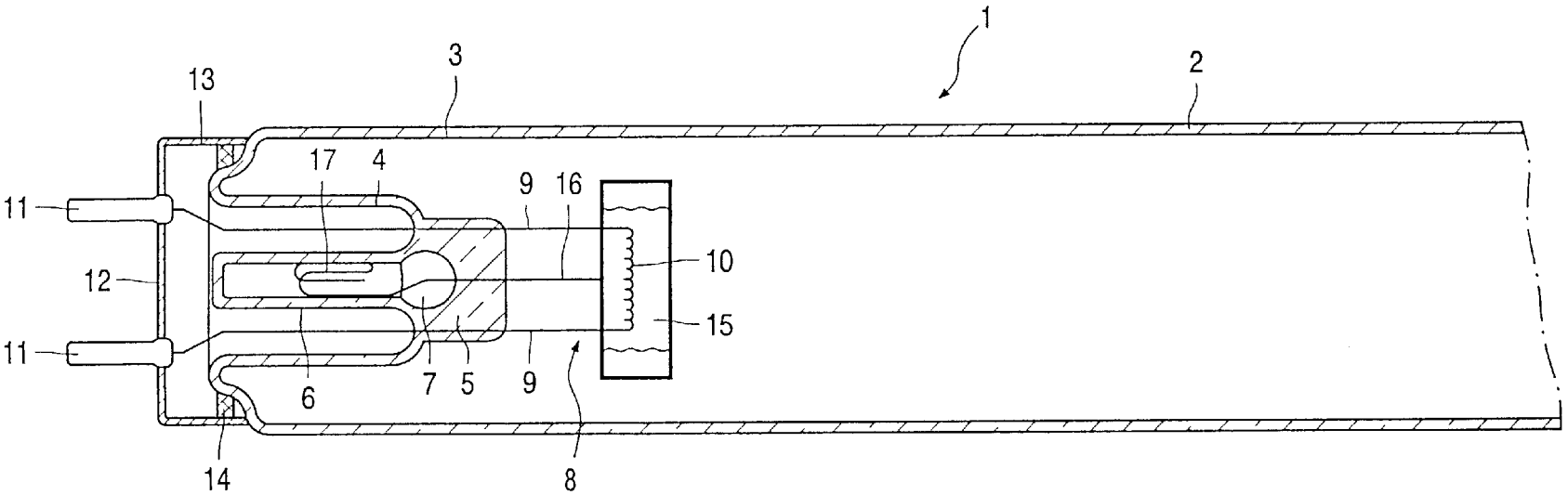

$$\xi = \frac{\frac{R_1}{R_2} + 1}{\frac{R_3}{R_4} + 1} < 0.4 \quad \text{or}$$

$$\alpha = \frac{R_1}{R_2} < 0.25$$

wherein $R_1/R_2$ =a degree for the effectivity for warming up the thin glass surface of the stem (5) where the exhaust tube (6) is connected to the stem (5) (the so-called "weak spot")

$R_3R_4$=a degree for the effectivity for transporting warmth through radiation from the stem (5) to the discharge vessel (2).

6 Claims, 2 Drawing Sheets

FLUORESCENT LAMP, AND METHOD OF MANUFACTURING SAME

The invention relates to a fluorescent lamp comprising a glass discharge vessel in which a gas is present, which discharge vessel is provided on either side with a tubular end portion with a longitudinal axis, each end portion being provided with a glass stem, while an exhaust tube extends axially outwards from the stem for receiving and/or discharging gases during lamp production, and an electrode extends through the stem axially inwards for maintaining a discharge in the discharge vessel.

An example of such a fluorescent lamp is one in which the end of the electrode extending in a inward direction is surrounded in a radial direction by a shield for catching material emitted by the electrode, which shield is fastened on an elongated support wich from the stem in an inward direction.

Mercury is the primary component for the (efficient) generation of ultraviolet (UV) light in mercury vapor discharge lamps. A luminescent layer comprising a luminescent material (for example a fluorescent powder) is present on the inner wall of the discharge vessel for the conversion of UV to other wavelengths, for example to UV-A and UV-B for sun tanning purposes (solarium lamps), or to visible radiation for general lighting purposes. The discharge vessel of a fluorescent lamp usually has a circular cross-section and comprises elongate embodiments (TL tubes) as well as compact embodiments (power-saving lamps). In the TL tube, said tubular end portions lie in one another's extensions and form a long, straight tube, whereas the end portions are interconnected via a curved tubular portion or a so-called bridge in the case of a compact power-saving lamp.

The fluorescent lamp is evacuated during manufacture through the glass exhaust tubes which are present at both ends of the lamp. The desired gas mixture is subsequently introduced into the lamp through these same exhaust tubes, whereupon the exhaust tubes are pinched shut and sealed off.

During operation, a voltage is maintained between the electrodes, which are also present at both ends of the lamp, so that a continuous discharge takes place and the mercury vapor emits said UV light. The ends of the electrodes are radially surrounded by respective shields, i so desired, because small particles are regularly emitted by the electrodes during operation, which particles would end up on the inner wall of the discharge vessel. This is undesirable because it reduces the light output in the relevant location, and the lamp would show al irregular light output, which is why said particles are intercepted by the shield. The shield, if present, is fastened in the glass stem by means of a wire-type support.

A problem which may arise in such a fluorescent lamp is that towards the end of lamp life, when the electrodes have been partly exhausted, the discharge may continue between portions of the electrodes which were not designed for this purpose, with the result that the stem will be covered with metal particles originating from these portions of the electrodes. A shield if indeed present, only protects in radial directions. As a result, the outer surface of the stem becomes conducting, so that the discharge will attach itself thereon, and the stem becomes so hot that it softens and deforms. A further consequence is that an unfavorable heat distribution causes the discharge vessel wall to become excessively hot for a longer period. It may occur in the end that the glass discharge vessel is cracked by the heat.

It is an object of the invention to provide a reliable fluorescent lamp in which the risk of the discharge vessel wall becoming hot at the end of lamp life is counteracted in a simple and efficient manner.

According to the invention, a fluorescent lamp of the kind mentioned in the opening paragraph s for this purpose characterized in that the fluorescent lamp complies with at least one of he following equations:

$$\xi = \frac{\frac{R_1}{R_2} + 1}{\frac{R_3}{R_4} + 1} < 0.4 \quad \text{and/or}$$

$$\alpha = \frac{R_1}{R_2} < 0.25$$

in which $R_1/R_2$=a measure for the effectivity with which the thin glass surface of the stem where the exhaust tube is fused to the stem (the so-called weak spot) is heated;

$R_3/R_4$=a measure for the effectivity with which heat is transported from the stem to the discharge vessel by means of radiation.

As will be explained in more detail below with reference to the Figure, the invention is based on the recognition that an existing lamp whose construction complies with one of the equations given above will exhibit a passive behavior towards the end of its useful life, i.e. the thin glass surface of the stem in the location where it is fused to the exhaust tube (the so-called weak spot) is quickly heated up so as to create a leak there, which will extinguish the lamp in time, i.e. before the glass discharge vessel as a whole is heated up too much.

A preferred embodiment of the fluorescent lamp according to the invention is characterized in that the current supply wires of the electrode are coated with a material which has a better thermal conductivity than nickel, which material preferably comprises copper. In another preferred embodiment, the current supply wires are entirely made of this material.

A further preferred embodiment of a fluorescent lamp according to the invention is characterized in that the distance from the core of at least one of the current supply wires of the electrode (preferably both current supply wires of the electrode) to the outer shell of the exhaust tube is smaller than 0.7 mm, in particular smaller than 0.4 mm, more in particular smaller than 0.2 mm.

A further preferred embodiment of a fluorescent lamp according to the invention is characterized in that the arithmetical product of the wall material thickness of the exhaust tube and the diameter thereof is smaller than 3, in particular smaller than 2, more in particular smaller than 1 $mm^2$ for a lamp having a discharge vessel diameter greater than 2.54 cm (for example lamp types T8 and T12), and smaller than 1.5, in particular smaller than 1, more in particular smaller than 0.5 $mm^2$ for a lamp having a discharge vessel diameter smaller than 2.54 cm (for example, lamp types PL, T5, and CFL).

A further preferred embodiment of a fluorescent lamp according to the invention is characterized in that the arithmetical product of the wall material thickness of the end of the discharge vessel (the carrier) and the diameter thereof is smaller than 9, in particular smaller than 8, more in particular smaller than 7 $mm^2$ for a lamp having a discharge vessel diameter greater than 2.54 cm (for example, lamp types T8 and T12), and smaller than 4, in particular smaller than 3, more in particular smaller than 2 $mm^2$ for a lamp having a discharge vessel diameter smaller than 2.54 cm (for example lamp types PL, T5, and CFL).

The invention also relates to a method of manufacturing a fluorescent lamp whereby a glass discharge vessel is provided with a tubular end portion with a longitudinal axis at either end, said end portion being provided with a glass stem, and an electrode is arranged in axial inward direction through the stem for maintaining a discharge in the discharge vessel, and an exhaust tube is provided so as to extend axially outward from the stem, through which exhaust tube the discharge vessel is filled with a gas, characterized in that at least one of the following equations is complied with:

$$\xi = \frac{\frac{R_1}{R_2} + 1}{\frac{R_3}{R_4} + 1} < 0.4 \quad \text{and/or}$$

$$\alpha = \frac{R_1}{R_2} < 0.25$$

Figure 2A:
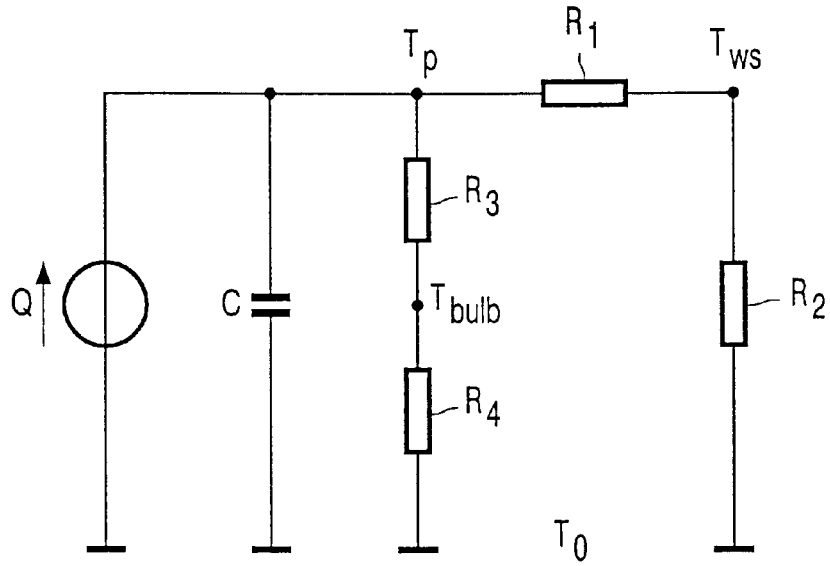
Figure 2B:
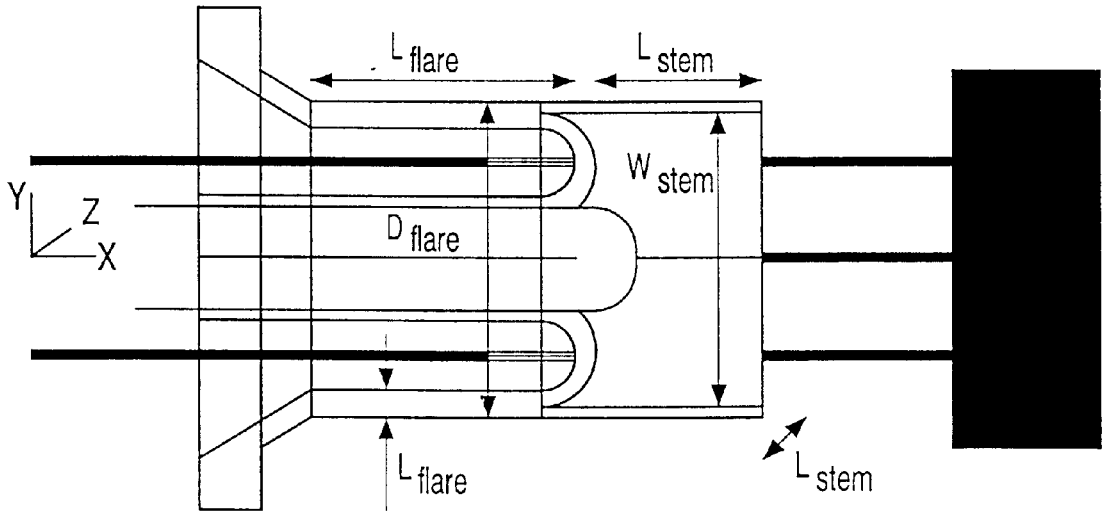

The invention will now be explained in more detail with reference to embodiments shown in the Figures, in which FIG. 1 is a cross-sectional view of part of a fluorescent lamp; and FIGS. 2A and 2B are an equivalent diagram and a diagrammatic longitudinal sectional view, respectively, of the lamp of FIG. 1.

In FIG. 1, a fluorescent lamp 1 comprises a glass discharge vessel in the form of a tube 2. The Figure only shows an end portion 3 of the lamp 1; in actual fact the lamp comprises two mutually opposed, identical end portions 3, each closing off one end of a long glass tube 2. The glass tube 2 is provided with a layer of fluorescent material on its inner surface, which material is capable of converting UV radiation into UV-A, UV-B, or visible light.

The glass tube 2 comprises at its end a cylindrical carrier 4 extending in inward direction on which a stem 5 is provided after current supply wires 9 and a support 16 have been fused therein. An exhaust tube 6 extending in outward direction is provided on the stem 5 and is in open communication with the contents of the tube 2 through a hole 7 in the stem 5. Before the lamp 1 is finished, the tube 2 is evacuated through the exhaust tube 6, which then still has a greater length than shown in the Figure, and the tube 2 is filled with the desired mixture of (rare) gases. At the same time, a quantity of mercury is placed in the lamp. Then the exhaust tube 6 is heated so that the glass softens, and is pinched shut to the length shown and sealed, so that the tube 2 is hermetically closed.

The lamp 1 is further provided on either side with an electrode 8 comprising two current supply wires 9 and a coiled tungsten wire 10. The coiled wire 10 is coated with a layer of emitter (comprising inter alia barium, strontium, calcium, and various oxides) for promoting the emission of electrons. The current supply wires 9 are retained by the stem 5, in which the wires are sealed in near the sides, and are furthermore connected to contact pins 11. The contact pins 11 are held in an electrically insulating disc 12 which is a part of a metal end shell 13. The end shell 13 is fastened to the glass tube by means of an annular layer of glue 14.

The contact pins 11 can be fastened in a luminaire which supplies the lamp 1 with current. The discharge which is created thereby between the electrodes 8 ensures that the mercury vapor molecules emit UV radiation which is converted into light of the desired wavelength(s) by the fluorescent layer on the inner surface of the tube 2.

A shield 15 may be present around the coiled wire 10 for the purpose of preventing material which sputters off the coiled wire 10 owing to the discharge which is maintained between the electrodes during operation from moving sideways and depositing on the inner surface of the tube 2, which would prevent a homogeneous light output along the length of the tube. This shield 15 is manufactured from a metal strip which was bent into an at least substantially closed circumference of oval shape. The shield 15 is partly broken away in the Figure, so that the coiled wire is clearly visible. The shield 15 is held in position by a wire-type bent metal support 16 which, like the current supply wires 9, was sealed into the stem 5, but into the central portion thereof. The support 16 may be manufactured, for example, from iron, nickel, iron/nickel, chromium/nickel, or molybdenum.

If present, the shield 15 is fastened to the end of the portion of the support 16 which extends in inward direction, while the clamping portion 17 of the support 16 extending in outward direction continues into the exhaust tube 6. This clamping portion 17 has a shape such that it clamps itself elastically in the exhaust tube 6 over a certain length, whereby the shield 15 is kept satisfactorily in position, also if the stem 5 is softened by heat. In the embodiment shown here, the clamping portion 17 has the shape of a kind of three-dimensional paperclip such that it bears on the circumference of the inside wall of the exhaust tube 6 in four locations. Such a shape has the additional advantage that the end of the clamping portion has oblique guiding surfaces, so that the support is guided into the exhaust tube and centered in a simple manner when being inserted into the exhaust tube.

Two rules of thumb will now be formulated with reference to FIG. 2A by means of which it can be ascertained whether an existing fluorescent lamp, for example the one shown in FIG. 1, will exhibit a passive behavior at the end of its life.

When the fluorescent lamp 1 of FIG. 1 reaches the end of its life, by which time the material of the electrode 8 has been partly used up, the so-called "end of life" process starts with a glow discharge at one of the current supply wires 9 of the electrode 8. In this phase of the process, the temperature of the glass discharge vessel 2 remains comparatively low. After this glowing phase, the process continues with a sodium discharge applying itself to the glass of the stem 5, this being the so-called "discharge on glass" phase. During this phase, the temperature of the glass discharge vessel 2 may rise as high as 250° C. At the end of this phase, a leak will normally have been created in a so-called "weak spot", i.e. a thin glass surface of the stem 5 where the exhaust tube 6 is fused to the stem 5.

The heat transport in the "discharge on glass" phase is the key process which defines the maximum temperature of the glass discharge vessel 2 and which also defines the period of time within which the lamp 1 will become inoperative during the entire "end of life" process. The rules of thumb given below are accordingly based on a simplified heat transport model of the "discharge on glass" phase.

In principle, heat transport may be represented by means of an equivalent diagram with resistors and capacitors. Such a diagram strongly resembles an electrical circuit diagram and may thus be treated in an analogous manner (voltage corresponding to temperature and current corresponding to power). FIG. 2A represents an equivalent diagram for the fluorescent lamp of FIG. 1. The situation has been somewhat simplified so as to be able to formulate a comparatively simple rule of thumb. The various elements of the diagram will be discussed below (the geometric parameters used are shown in FIG. 2B and will be explained in the respective description).

Parameters are defined as follows:

$T_{bulb}$ = the temperature of the glass of the discharge vessel;

$T_o$ = the ambient temperature outside the fluorescent lamp;

$T_{ws}$ = the temperature of the weak spot;

$T_p$ = the temperature of the stem.

$Q$ a heat of discharge $Q$ (represented as a current source) heats the stem 5 which has a temperature $T_p$.

C the stem is heated up in accordance with an exponential curve. The heating-up time depends on the thermal capacity of the glass of the stem 5. It is assumed in the equivalent diagram that all other elements follow the heating-up curve of the stem 5. This means in practice that there may be deviations if other elements heat up considerably more slowly than the stem 5.

$R_1$ heat is transported from the stem 5 to the weak spot via a thermal resistance $R_1$. The heat conduction is equal to the reciprocal, $1/R_1$. Taking into account the most important factors (measurements in combination with an extensive model of finite elements have shown which elements can be disregarded), $R_1$ may be written as:

$$R_1 = \frac{L_{pinch}}{\lambda_{glass} \cdot W_{stem} \cdot t_{stem}}$$

the geometric parameters used are clarified in FIG. 2B. $\lambda_{glass}$ relates to the thermal conductivity of glass. The thermal conductivity is higher as the stem 5 is longer or has a smaller cross-section. The heat flow from the stem 5 to the weak spot heats up the latter to a temperature $T_{ws}$. When the weak spot reaches a temperature of approximately 600° C., a leak will arise owing to the pressure difference between the lamp 1 and the environment. The temperature of the weak spot is accordingly a very important variable in the "end of life" process.

$R_2$ heat is transported from the weak spot to the cap shell 13, and from there to the fastening of the lamp 1. Heat flows from the weak spot to the fastening through a thermal resistance $R_2$ in the simplified model. It is assumed for simplicity's sake that the fastening retains the ambient temperature $T_0$. The thermal resistance of the carrier 4 mainly accounts for said thermal resistance $R_2$ and may be expressed as follows:

$$R_2 = \frac{L_{flare}}{\lambda_{glass} \cdot \pi \cdot D_{flare} \cdot t_{flare}}$$

Again, the thermal resistance will rise as the length of the end of the glass discharge vessel increases and as its cross-section decreases.

$R_1/R_2$ the ratio of $R_1$ to $R_2$ is a measure for the effectivity with which the weak spot is heated up. The lower the ratio of $R_1$ and $R_2$, the more the temperature of the weak spot will approximate the temperature of the stem. The better the heating-up process of the weak spot, the faster the lamp 1 will fail at the end of its life. In an equation, said ratio of $R_1$ to $R_2$ is equal to:

$$\frac{R_1}{R_2} = \frac{T_p - T_{ws}}{T_{ws} - T_0} = \frac{\pi \cdot D_{flare} \cdot t_{flare} \cdot L_{stem}}{W_{stem} \cdot t_{stem} \cdot L_{flare}}$$

$R_3/R_4$ furthermore, the stem 5 loses heat to the glass discharge vessel 2 through radiation. $R_3$ is a measure for the thermal resistance experienced by radiation from the stem 5 to the glass discharge vessel 2. The temperature of the glass discharge vessel 2 adjacent the stem 5 will rise to a temperature $T_{bulb}$ owing to this heat radiation. Heat is transported from the glass discharge vessel 2 to the surroundings by means of convection and radiation, which is subject to a thermal resistance $R_4$. The ratio of $R_3$ to $R_4$ represents the effectivity of the heat transport from the stem 5 to the glass discharge vessel 2 by means of radiation. This ratio should be as low as possible so as to safeguard a lowest possible temperature of the glass discharge vessel 2 during the "end of life" process. A good estimate for the ratio of $R_3$ to $R_4$ based on an estimate of the heat transport coefficients $h_3$ and $h_4$ for convection and radiation is:

$$\frac{R_3}{R_4} = \frac{h_4}{h_3} \frac{\pi \cdot D_{bulb}^2}{A_{stem}} = 0.13 \frac{\pi \cdot D_{bulb}^2}{A_{stem}}$$

with $$A_{stem} = W_{stem} \cdot t_{stem} + 2(W_{stem} + t_{stem}) \cdot L_{stem}$$

The ratio of $T_{bulb}$ and $T_{ws}$ can be derived from the equivalent diagram of FIG. 2A. This may be done in a manner analogous to the derivation of a voltage ratio in an electric circuit. The result is:

$$\frac{T_{bulb} - T_o}{T_{ws} - T_o} = \frac{\frac{R_1}{R_2} + 1}{\frac{R_3}{R_4} + 1}$$

This ratio is a measure for the temperatures reached during the "end of life" process. A ratio of 0.5 means, for example, that the stable temperature of the glass discharge vessel 2 is equal to half the stable temperature of the weak spot. The temperature at which a leak is created at the area of the weak spot is 600 ° C. According to the equation given above, the temperature of the glass discharge vessel 2 should accordingly be approximately 300 ° C. During an actual "end of life" process, the temperatures will not always reach a stable level, and the temperature of the glass discharge vessel 2 will be lower. Extensive experiments have shown it to be possible to determine the ratio for which the so-called "end of life" behavior is still acceptable. This leads to the following rule of thumb:

$$\xi = \frac{T_{bulb} - T_o}{T_{ws} - T_o} = \frac{\frac{R_1}{R_2} + 1}{\frac{R_3}{R_4} + 1} < 0.4$$

If the equations for $R_1/R_2$ and $R_3/R_4$ mentioned above are used, this rule of thumb is applicable to all "end of life" processes in which the temperature of the glass discharge vessel 2 reached during this process is important. This is the case, for example, in type T8 lamps, i.e. lamps having a diameter of the discharge vessel 2 greater than 2.54 cm.

In some cases the temperature of the glass discharge vessel 2 is less important, for example if the "end of life" process proceeds comparatively quickly. The following rule of thumb may be used in such a case, this rule of thumb being a measure for the speed or effectivity of the process:

$$\alpha = \frac{T_p - T_{ws}}{T_{ws} - T_o} = \frac{R_1}{R_2} = \frac{\pi \cdot D_{flare} \cdot t_{flare} \cdot L_{stem}}{W_{stem} \cdot t_{stem} \cdot L_{flare}} < 0.25$$

It is noted that the two rules of thumb have an interrelationship on account of corresponding parameters; the improvement of one parameter does not necessarily improve both rules of thumb.

FIG. 2B is a diagrammatic longitudinal sectional view of the lamp 1 of FIG. 1 in which the parameters used in the second rule of thumb are indicated:

$L_{stem}$ = length of stem 5;

$W_{stem}$ = width of stem 5;

$t_{stem}$ = wall material thickness of stem 5;

$L_{flare}$ = length of carrier 4;

$T_{flare}$ = diameter of carrier 4;

$t_{flare}$ = wall material thickness of carrier 4;

$D_{bulb}$ = external diameter of the discharge vessel 2;

$A_{pinch}$ = surface area of stem 5.

What is claimed is:

1. A fluorescent lamp (1) comprising a glass discharge vessel (2) in which a gas is present, which discharge vessel (2) is provided on either side with a tubular end portion (3) with a longitudinal axis, each end portion (3) being provided with a glass stem (5), while an exhaust tube (6) extends axially outward from the stem (5) for receiving and/or discharging gases during the manufacture of the lamp (1), and an electrode (8) extends through the stem (5) axially inward for maintaining a discharge in the discharge vessel (2), characterized in that the fluorescent lamp (1) complies with at least one of the following equations:

$$\xi = \frac{\frac{R_1}{R_2} + 1}{\frac{R_3}{R_4} + 1} < 0.4 \quad \text{and/or}$$

$$\alpha = \frac{R_1}{R_2} < 0.25$$

in which $R_1/R_2$=a measure for the effectivity with which the thin glass surface of the stem (5) where the exhaust tube (6) is fused to the stem (5) is heated;

$R_3/R_4$=a measure for the effectivity with which heat is transported from the stem (5) to the discharge vessel (2) by means of radiation.

2. A fluorescent lamp (1) as claimed in claim 1, wherein current supply wires (9) of the electrode (8) are coated with a material which has a better thermal conductivity than nickel, which material preferably comprises copper.

3. A fluorescent lamp (1) as claimed in claim 1, wherein the distance from the core of at least one of the current supply wires (9) of the electrode (8) (preferably both current supply wires (9) of the electrode (8)) to the outer surface of the exhaust tube (6) is smaller than 0.7 mm, in particular smaller than 0.4 mm, more in particular smaller than 0.2 mm.

4. A fluorescent lamp (1) as claimed in claim 1, wherein the arithmetical product of the wall material thickness of the exhaust tube (6) and the diameter thereof is smaller than 3, in particular smaller than 2, more in particular smaller than 1 $mm^2$ for a lamp having a diameter of the discharge vessel (2) which is greater than 2.54 cm; and smaller than 1.5, in particular smaller than 1, more in particular smaller than 0.5 $mm^2$ for a lamp having a diameter of the discharge vessel (2) which is smaller than 2.54 cm.

5. A fluorescent lamp (1) as claimed in claim 1, wherein the arithmetical product of the wall material thickness of the end of the discharge vessel (2) and the diameter thereof is smaller than 9, in particular smaller than 8, more in particular smaller than 7$mm^2$ for a lamp having a diameter of the discharge vessel (2) which is greater than 2.54 cm; and smaller than 4, in particular smaller than 3, more in particular smaller than 2 $mm^2$ for a lamp having a diameter of the discharge vessel (2) which is smaller than 2.54 cm.

6. A method of manufacturing a fluorescent lamp whereby a glass discharge vessel (2) is provided with a tubular end portion (3) with a longitudinal axis at either end, each end portion (3) being provided with a glass stem (5), and an electrode (8) is passed in axial inward direction through the stem (5) for generating and maintaining a discharge in the discharge vessel (2), and an exhaust tube (6) is provided so as to extend axially outward from the stem (5), through which exhaust tube (6) the discharge vessel (2) is filled with a gas, characterized in that at least one of the following equations is complied with:

$$\xi = \frac{\frac{R_1}{R_2} + 1}{\frac{R_3}{R_4} + 1} < 0.4 \quad \text{and/or}$$

$$\alpha = \frac{R_1}{R_2} < 0.25$$

in which $R_1/R_2$=a measure for the effectivity with which the thin glass surface of the stem (5) where the exhaust tube (6) is fused to the stem (5) is heated;

$R_3/R_4$=a measure for the effectivity with which heat is transported from the stem (5) to the discharge vessel (2) by means of radiation.

* * * * *